US007112059B2

(12) United States Patent
Donnelly

(10) Patent No.: US 7,112,059 B2
(45) Date of Patent: Sep. 26, 2006

(54) APPARATUS AND METHOD FOR SHUTTING DOWN FUEL FIRED APPLIANCE

(75) Inventor: Donald E. Donnelly, Fenton, MO (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 11/068,607

(22) Filed: Feb. 28, 2005

(65) Prior Publication Data

US 2005/0202358 A1 Sep. 15, 2005

Related U.S. Application Data

(63) Continuation-in-part of application No. 10/799,159, filed on Mar. 12, 2004, now Pat. No. 6,908,300.

(51) Int. Cl.
*F22B 37/42* (2006.01)
*F23N 5/24* (2006.01)

(52) U.S. Cl. ..... 431/22; 431/6; 431/13; 431/16; 431/76; 122/504

(58) Field of Classification Search ..... 431/6, 431/13, 16, 21, 22, 75–78; 122/504, 17.1, 122/17.2, 14.2; 340/632
See application file for complete search history.

(56) References Cited

U.S. PATENT DOCUMENTS 3,961,900 A * 6/1976 Gintella et al. ..... 422/96
4,032,286 A * 6/1977 Kobayashi et al. ..... 431/76
4,129,030 A * 12/1978 Dolan ..... 73/31.05
4,223,692 A * 9/1980 Perry ..... 137/78.4
4,358,265 A * 11/1982 Tanaka et al. ..... 431/76
4,412,809 A * 11/1983 Yamaguchi et al. ..... 431/76
4,482,311 A * 11/1984 Wada et al. ..... 431/15
5,165,883 A * 11/1992 Van Bemmel ..... 431/6
5,419,358 A * 5/1995 Sun ..... 137/78.4
5,508,568 A * 4/1996 Mammen ..... 307/117
5,540,273 A * 7/1996 Polk et al. ..... 165/11.1
6,722,876 B1 * 4/2004 Abraham et al. ..... 431/22
6,908,300 B1 * 6/2005 Donnelly ..... 431/22
2002/0134322 A1 * 9/2002 Dolan ..... 122/504

* cited by examiner

*Primary Examiner*—Carl D. Price
(74) *Attorney, Agent, or Firm*—Harness Dickey & Pierce, PLC

(57) ABSTRACT

An apparatus is provided for controlling the operation of a gas fired appliance having a gas valve circuit for enabling the flow of gas to the burner. The apparatus comprises a sensor capable of detecting the presence of flammable vapor, a switching means in series with the gas valve solenoid circuit for interrupting a thermocouple voltage to the gas valve solenoid to disable the flow of gas, and a fuse that normally conducts a current to the switching means to maintain the switching means in a conductive state for applying a thermocouple voltage to the gas valve solenoid. In response to the detection by the sensor of the presence of a predetermined level of flammable vapor concentration, a second switch supplies a higher current through the fuse. The higher current causes the fuse to blow and interrupt the current for maintaining the switching means in a conductive state, such that the switching means interrupts the thermocouple voltage applied to the gas valve solenoid to shut off the gas to the burner.

22 Claims, 2 Drawing Sheets

APPARATUS AND METHOD FOR SHUTTING DOWN FUEL FIRED APPLIANCE

CROSS REFERENCE TO RELATED APPLICATIONS

This application is a continuation-in-part of commonly assigned, U.S. patent application Ser. No. 10/799,159 filed Mar. 12, 2004, now issued as U.S. Pat. No. 6,908,300, which is hereby incorporated herein by reference.

BACKGROUND OF THE INVENTION

The present invention generally relates to fuel-fired heating appliances such as water heaters, and more particularly relates to an apparatus for sensing the presence of flammable vapors near the burner of a fuel-fired appliance and responsively shutting down the operation of the burner.

Residential and commercial gas-fired water heaters typically comprise a main burner and a standing pilot burner disposed within a combustion chamber below a cylindrical water tank. The burner is supplied with gas through a gas valve, and with air through an air inlet screen. Such standing pilot water heaters vent the combustion air without the use of a fan, and operate independent of the electrical power within the building. While conventional water heater appliances of this type operate reliably and safely, there may exist the possibility that the burner could cause flammable vapors external to the appliance to be ignited. The resulting flame could potentially propagate out of the appliance into the ambient environment around the appliance.

Efforts to mitigate the potential hazard posed by the presence of flammable vapors in proximity to a gas burning appliance have been previously directed to a control circuit in connection with a sensor that responds to flammable vapors by changing resistance to effect shut down of burner operation. Burner operation may be restored when the sensor returns to its original resistance after the vapors dissipate. These previous types of sensor systems do not indefinitely shut down the burner from further operation upon first detecting the presence of flammable vapors. The flammable vapor sensors presently used, however, have been known to become erratic and unreliable once they are exposed to a significant concentration of flammable vapors. Attempts have been previously made to employ a microprocessor to shut off burner operation in response to a sensor detecting the presence of flammable vapors. Such microprocessor-based electronic systems have the ability to lockout the appliance upon detecting the presence of flammable vapors, but necessitate the provision of a power source for the microprocessor. Such microprocessor controls are either expensive or impractical, in that a new gas water heater using a microprocessor control requires installation of electrical power to the water heater, or requires frequent battery replacement due to the microprocessor's power consumption.

SUMMARY OF THE INVENTION

There is provided, in accordance with one aspect of the invention, one embodiment of an apparatus that provides for controlling the operation of a fuel-fired appliance burner having a gas valve circuit for enabling the flow of gas to the burner. The apparatus comprises a sensor capable of detecting the presence of flammable vapor, a switching means in series with the gas valve solenoid circuit for interrupting a thermocouple voltage to the gas valve solenoid to disable the flow of gas, and a fuse that normally conducts a current to the switching means to maintain the switching means in a conductive state for applying a thermocouple voltage to the gas valve solenoid. Of course instead of a fuse, there could be some other element that permanently or temporarily interrupts power in response to an overload, such as a resettable circuit breaker or other device. In response to the detection by the sensor of the presence of a predetermined level of flammable vapor concentration, a second switch supplies a higher current through the fuse. The higher current causes the fuse to blow and interrupt the current for maintaining the switching means in a conductive state, such that the switching means interrupts the thermocouple voltage applied to the gas valve solenoid to shut off the gas to the burner.

In another aspect of the present invention, one embodiment of an apparatus is provided that shuts down burner operation upon sensing the presence of flammable vapors by blowing a fuse for disabling the thermocouple voltage applied to the gas valve for supplying gas to the burner. This embodiment of the apparatus preferably comprises a sensor capable of sensing the presence of flammable vapors in the ambient environment around a fuel-fired heating appliance, and responsively interrupts the thermocouple voltage to the gas valve to discontinue further operation of the appliance burner.

In yet another aspect of the present invention, at least some embodiments may be battery operated, and provide for shutting down burner operation upon detecting a low battery condition to prevent operation of the burner when the apparatus does not have sufficient power to respond to the presence of flammable vapors.

These and other features and advantages of the present invention will become apparent from the following detailed description of the various embodiments for a gas fired water heater design, as well as the designs of other types of fuel fired heating appliances, which illustrates by way of example the principles of the invention

BRIEF DESCRIPTION OF THE DRAWINGS

Corresponding reference numerals indicate corresponding parts throughout the views of the invention.

DETAILED DESCRIPTION OF THE EMBODIMENTS

Figure 1:
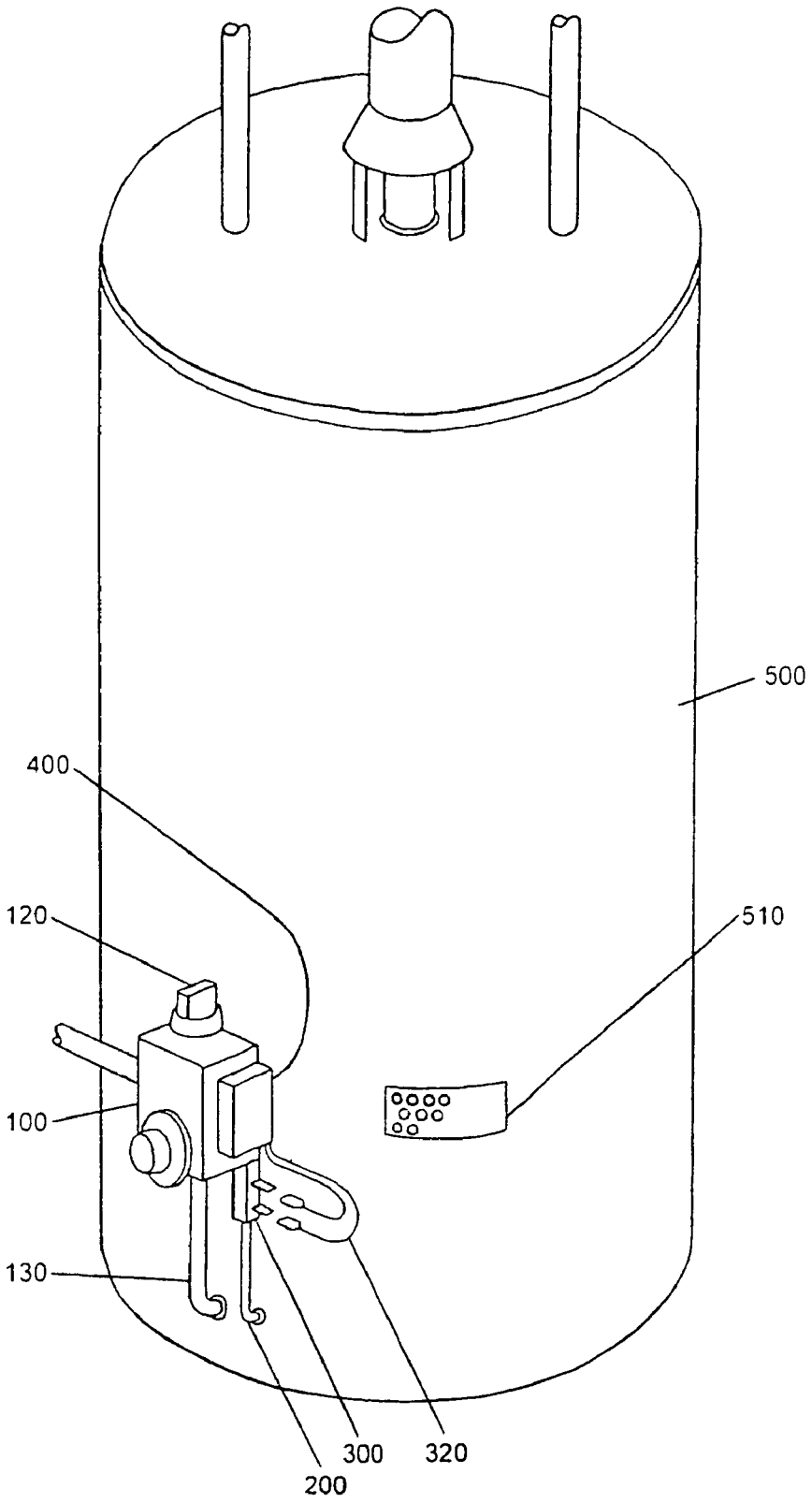
FIG. 1 is an illustration of a gas water heater employing the flammable vapor sensing apparatus according to the principles of the present invention.

One embodiment of an apparatus according to the principles of the present invention is illustrated in FIG. 1, which shows the apparatus 400 attached to a gas valve 100 of a gas water heater appliance 500. A typical gas water heater appliance generally has a burner disposed within a combustion chamber at the bottom of the appliance below a cylindrical water tank. FIG. 1 illustrates such a water heater having a gas valve 100 for supplying gas through tube 130 to the burner, and an air inlet screen 510 for supplying air to the burner (not shown). The appliance also comprises a thermocouple 200 for generating a voltage when exposed to a flame. The typical water heater appliance gas valve 100 has a knob 120 that must be depressed to supply gas while lighting a pilot burner flame. The pilot flame generates a thermocouple voltage that is in connection with the gas valve 100, for enabling the valve to supply gas to the burner at the bottom of the water heater appliance 500. The thermocouple of the water heater appliance 500 is a 2-grid power generator that can provide up to 200 milliamps, and is manufactured by White-Rodgers, a Division of Emerson Electric Co. It should be noted that the gas valve circuit could be configured to allow for the use of a standard appliance thermocouple generator.

The thermocouple 200 shown in FIG. 1 is connected to a gas valve circuit of the gas valve 100 through an adapter 300. The adapter 300 comprises terminals for connection of the apparatus in series with the thermocouple 200 and gas valve circuit of the gas valve 100. The adapter 300 of the present invention is preferably an Energy Cut Off for a thermocouple, part number F145-1109 manufactured by White-Rodgers, a Division of Emerson Electric Co. It should be noted that the adaptor for enabling connection with the thermocouple may be any suitable adapter, and may also be incorporated into the construction of the thermocouple itself. A pair of connectors 320 provide for connection of a first switching means 430 of the apparatus 400 in series with the gas valve circuit and thermocouple voltage through the adapter 300. A current is conducted through a fuse 500 to the first switching means 430 for maintaining the first switching means 430 in a conductive state. Specifically, the apparatus 400 comprises a Field Effect Transistor (FET) switch 430 that is connected in series with the gas valve solenoid and thermocouple voltage, and a sensor that detects the presence of flammable vapors and responsively switches a second switch device 420 to supply a high current to the fuse 500. The fuse 500 responsively opens to interrupt the current maintaining or gating the first switching means 430 in a conductive state, and causes the first switching means 430 to interrupt the gas valve circuit and shut off the burner. Thus, the apparatus 400 senses the presence of flammable vapors around the gas water heater 500, and shuts down the operation of the appliance before the flammable vapors can accumulate or rise to the air inlet 510 of the water heater.

Figure 2:
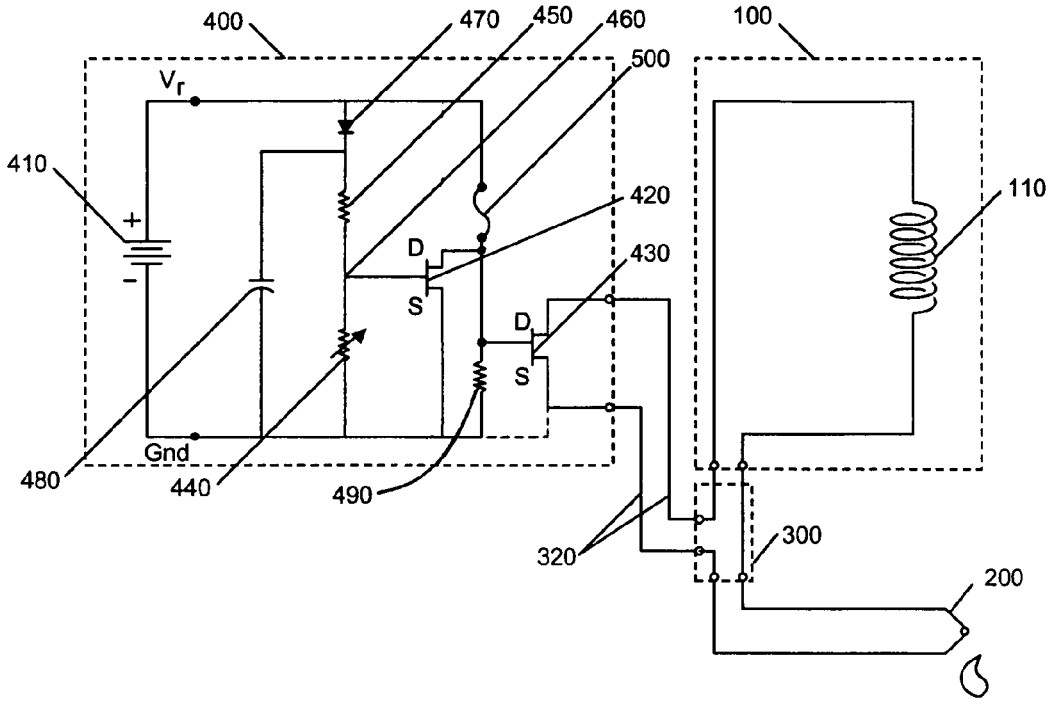
FIG. 2 is a circuit diagram of an appliance burner control circuit in connection with the flammable vapor sensing apparatus according to the principles of the present invention.

A circuit diagram of the apparatus is shown in FIG. 2, and more specifically details the connection of the apparatus in series with the previously described gas valve circuit. The apparatus is generally indicated as 400 in FIG. 2, and comprises a battery 410 connected to a voltage divider circuit comprising a resistor (R1) 450 and a resistive sensor (R3) 440 that increases in resistance in the presence of flammable vapors. The voltage divider circuit is designed such that it draws very low current to allow for long battery life. It should be noted that in the absence of flammable vapors, the current draw of the voltage divider circuit and the gate of the first switching means 430, or FET, are the only load on the battery, which is a distinct advantage this circuit over a microprocessor circuit that requires additional power for operating the microprocessor. Thus, the present invention provides the advantage of improved battery life over microprocessor based systems. The resistive sensor 440 is capable of detecting the presence of flammable vapors and responsively changing in resistance. Specifically, the particular sensor of the present invention increases in resistance as the flammable vapor concentricity rises, and is a polymer-absorption Chemiresistor manufactured by Therm-O-Disc Corporation. The resistance of the sensor is about 15 k to 20 k ohms in the absence of flammable vapors, and upon exposure to 50 percent of the low flammability level concentration of flammable vapors the resistance increases to over 100 k ohms within about 60 seconds.

The apparatus further comprises a second switching device that switches a higher current from a battery source through the fuse, which opens the fuse and interrupts the current for maintaining the first switching means in a conductive state. In one embodiment, the second switching means 420 is preferably a Field Effect Transistor (FET) but may alternately be a relay or other suitable electronic component. In the absence of flammable vapors, the FET 420 is not in a conductive state, and the battery voltage Vr to the fuse 500 establishes current through the fuse 500 and to the gate of the FET 430 to hold the transistor in a conductive state. In this state, the FET 430 in series with the gas valve solenoid 110 is conductive to allow for gas flow to the burner. When the sensor 440 detects a 50 percent low flammability level concentration, the voltage potential at node 460 of the voltage divider circuit (R1 and R3) rises to a level that will gate on a Field Effect Transistor 420. The FET 420 is thereby switched on when the sensor 440 detects a predetermined flammable vapor concentration, such that the FET 420 shorts resistor (R2) 490 to establish a high current from the battery 410 through a fuse 500 and through the FET 420 to ground. It should be noted that the fuse 500 is normally conducting current to the FET 430, and the fuse 500 is configured to open only when a predetermined level of current is conducted through the fuse. The battery then generates a large current between Vr and ground through the fuse 500 that will cause the fuse 500 to blow or open. The open fuse 500 interrupts the voltage applied to the gate of the Field Effect Transistor 430, which interrupts the application of thermocouple voltage at 200 through the FET 430 to the gas valve coil 110. The interruption of thermocouple voltage will cause the solenoid of the gas valve to shut off gas flow through the valve to the burner and shut down the appliance. Where a battery source with limited current capacity is employed, the circuit may further comprise a diode 470 in series with the voltage divider circuit and a capacitor 480 parallel to the voltage divider circuit, to maintain the battery voltage and current level when the FET 420 is switched on to blow the fuse. In one embodiment, the battery source comprises two AAA batteries in series, but may alternately comprise any arrangement of one or more batteries suitable for providing sufficient current to open the fuse 500. The fuse of the present invention is preferably a slimline manufactured by Little Fuse, and is rated to open at a current in the range of about 0.1 to 0.2 amps.

In operation, the thermocouple 200 is exposed to flame to generate a voltage that is applied to the gas valve coil 110 of the gas valve 100. The thermocouple voltage is connected to the adaptor 300, which allows for connection of the FET 430 in series between the thermocouple 200 and the gas valve coil 110. The FET 430 is connected in series with the gas valve circuit through the adaptor 300 via connection leads 320. A reference ground may be provided between the apparatus ground and the thermocouple circuit 200, to provide an electrical ground for the gate to the FET 430. The thermocouple 200 supplies current through the adapter 300, through the leads 320 and the FET 430, and through the gas valve coil 110 for enabling the gas valve 100 to supply gas for operation of the burner appliance. In the absence of flammable vapors, the battery establishes a current through the voltage divider circuit and a current through the fuse 500 and the resistor 490 to gate the FET 430 to an on position. Current is not established through the FET 420 in the absence of flammable vapors. When the sensor 440 detects the presence of a predetermined flammable vapor concentration, the voltage divider provides a voltage potential at node 460 that gates the FET 420 on and shorts resistor (R2)

490 to establish a high current from the battery 410 through the fuse 500 that causes the fuse to blow. The fuse will blow, or open after about 5 seconds, at which time the connection of the battery 410 with the gate of the FET 430 will be interrupted. This will cause the FET 430 to be switched to an open or non-conductive state and the thermocouple 200 will no longer be connected to the gas valve coil 110 which will shut off the flow of gas.

Once the fuse 500 of the apparatus 400 has opened, the gas valve coil 110 that operates a solenoid will be de-energized to discontinue the flow of gas through the gas valve 100 to the appliance burner. Even if the sensor 440 returns to its nominal resistance when the flammable vapors have dissipated, attempts to restore the gas valve's operation will not be possible. Depressing the gas valve knob 120 will supply gas to the pilot burner, but lighting the pilot flame will not provide a thermocouple voltage to the gas valve coil 110 since the open fuse 500 will not allow the FET 430 to be switched on to reestablish the connection to the gas valve coil 110. Thus, subsequent attempts to restore operation of the appliance burner will not be possible until the apparatus is serviced by a repair technician. Replacement of the sensor 440 and the fuse 500, or the apparatus 400, will ensure reliable sensor operation for detecting the presence of flammable vapors in the proximity of the appliance. The present invention accordingly provides an apparatus for shutting down an appliance burner that has a simplified construction with low cost, long battery life and reliable sensing of the presence of flammable vapors.

In a second embodiment, the resistor 430 may alternately comprise a second sensor 430 that decreases in resistance as the concentration of predetermined vapor increases. For example, the second sensor 430 may be a carbon monoxide sensor that decreases in resistance upon sensing a predetermined concentration of carbon monoxide gas. When the second sensor 430 detects a predetermined concentration of carbon monoxide gas, the voltage potential at node 460 of the voltage divider circuit (R1 and R3) rises to a level that will gate on a Field Effect Transistor 420. The FET 420 is thereby switched on when the sensor 430 detects a predetermined carbon monoxide gas concentration, such that the FET 420 shorts resistor (R2) 490 to establish a high current from the battery 410 through a fuse 500 and through the FET 420 to ground. The battery then generates a large current between Vr and ground through the fuse 500 that will cause the fuse 500 to blow or open. The open fuse 500 interrupts the voltage applied to the gate of the Field Effect Transistor 430, which interrupts the application of thermocouple voltage at 200 through the FET 430 to the gas valve coil 110. The interruption of thermocouple voltage will cause the solenoid of the gas valve to shut off gas flow through the valve to the burner and shut down the appliance. Therefore, in this second embodiment, either the first sensor 430 or the second sensor 440 in the voltage divider are independently capable of switching a high current through the fuse 500 to cause the gas flow to be shut off. Thus, the second embodiment may monitor the presence of both flammable vapors and carbon monoxide gas, to provide for shutting down the fuel fired heating appliance. It should be noted that the second sensor may alternatively sense nitrous oxide, or other gases, and may also comprise a resistor-switch arrangement.

The apparatus may further comprise circuitry that provides for disabling burner operation when a low battery voltage condition occurs. When the battery voltage drops below a reference voltage, the voltage applied to the gate of the FET 430 will no longer be sufficient to hold the FET 430 in an on or conductive state. The FET 430 will then interrupt the thermocouple voltage 200 applied to the gas valve coil circuit 100 to disable burner operation. The predetermined reference voltage of the present invention is preferably about 2.5 volts.

Likewise, the apparatus may also further comprise an audible alarm that is activated when the sensor 440 detects a flammable vapor presence and causes the FET 420 to switch. When the FET 420 is gated on, the FET output voltage drives a transistor (not shown) for switching on a self oscillating piezo (not shown), to accordingly provide an audible alarm for alerting an occupant that a flammable vapor presence has been detected.

It should be noted that the FET 430 that serves as the circuit-interrupting device of the present invention may also be replaced with a relay device that can interrupt the thermocouple circuit. The opening of fuse 500 may be used to remove voltage from a relay coil, which would open the closed contacts in connection with the thermocouple voltage and the gas valve coil circuit. The relay coil would ideally draw very little current, similar to the gate of the FET switch. The relay would remain in its present open state, thereby providing the same indefinite shut down of the gas valve circuit and burner operation as the fuse device.

Additional design considerations, readily apparent to one of ordinary skill in the art, such as modification of the apparatus to incorporate a low-cost microprocessor with reduced power consumption that may become available in the future, may enable simplification of circuitry and improved battery life in the present invention. It should be apparent to those skilled in the art that various modifications such as the above may be made without departing from the spirit and scope of the invention. More particularly, the apparatus may be adapted to any of a variety of different gas fired appliances including gas clothes dryers and furnaces. Accordingly, it is not intended that the invention be limited by the particular form illustrated and described above, but by the appended claims.

What is claimed is:

1. A control for operating a thermocouple-powered solenoid actuated gas valve, the control comprising:
   - a first switch having open and closed states, and which when in the closed state provides power from the thermocouple to the solenoid;
   - a power lead for providing power to the first switch to keep the first switch in the closed state, the power lead having a fuse therein, which when triggered interrupts power to the first switch;
   - a flammable gas sensor for sensing flammable gas; and a second switch, responsive to the flammable gas sensor, for providing power to trigger the fuse to interrupt power to the first switch, causing the first switch to close and interrupt power to the solenoid, thereby closing the gas valve.

2. An apparatus for controlling the operation of a fuel-fired appliance burner having a gas valve solenoid circuit for enabling the flow of gas to the burner, comprising:
   - a sensor capable of detecting the presence of flammable vapor;
   - a first switch in series with the gas valve solenoid circuit for interrupting a thermocouple voltage to the gas valve solenoid to disable the flow of gas;
   - a fuse that normally conducts a current to the first switch to maintain the first switch in a conductive state for applying a thermocouple voltage to the gas valve solenoid;
   - a second switch that responds to detection by the sensor of the presence of a predetermined level of flammable vapor concentration, by supplying a current through the fuse sufficient to interrupt the current for maintaining the first switch means in a conductive state, such that the first switch interrupts the thermocouple voltage applied to the gas valve solenoid to shut off gas to the burner.

3. The apparatus of claim 2 wherein the resistance of the sensor resistance increases as the concentration of flammable vapors increases.

4. The apparatus of claim 3 wherein the sensor is incorporated in a voltage divider circuit that comprises a resistor in series with the sensor, and an increase in resistance of the sensor will yield a voltage potential from the voltage divider that switches on the second switch.

5. The apparatus of claim 4 wherein the second switch is a field effect transistor.

6. The apparatus of claim 5 wherein the second switch switches on to conduct a high current through the fuse causing the fuse to blow when the sensor incorporated in the voltage divider circuit detects a predetermined flammable vapor concentration.

7. The apparatus of claim 4 wherein the predetermined flammable vapor concentration is about 50 percent of the lower flammability level.

8. The apparatus of claim 6 further comprising a battery for supplying voltage to the voltage divider circuit and the current switched to the fuse.

9. The apparatus of claim 8 further comprising means for shutting down the appliance burner circuit when the battery voltage level is below a predetermined value.

10. The apparatus of claim 9 further comprising an audible alarm for alerting the occupant when the sensor detects the predetermined flammable vapor concentration.

11. A control circuit for shutting off a fuel-fired appliance burner having a thermocouple voltage that enables a gas valve solenoid to supply fuel to the appliance burner, the control circuit comprising:

a power source for powering the control circuit, a first switch that is connected in series with the gas valve solenoid of the appliance in a manner such that the thermocouple current to the gas valve solenoid is interrupted when the first switch opens to cause the flow of gas to the burner to be shut off;

a sensor capable of detecting the presence of flammable vapor, the sensor responsively changing in resistance as the concentration of flammable vapor changes;

a fuse that normally conducts current from the power source to the first switch to maintain a conductive state of the first switch for supplying thermocouple current to the gas valve solenoid;

a second switch, which, responsive to detection by the sensor of the presence of a predetermined level of flammable vapor concentration, supplies a higher current through the fuse which opens to interrupt the current for maintaining the first switch in a conductive state, such that the first switch interrupts the thermocouple voltage applied to the gas valve solenoid to shut off the gas to the burner; and a voltage divider circuit including a resistor and the sensor, wherein the detection of a predetermined level of flammable vapors by the sensor causes the voltage potential between the resistor and the sensor to activate the second switch for switching a current from the power source through the fuse sufficient to open the fuse to interrupt current for maintaining the first switch in a conductive state, such that the flow of gas to the burner is shut-off.

12. The control circuit of claim 11 wherein the resistance of the sensor increases as the concentration of flammable vapor increases.

13. The apparatus of claim 12 wherein the second switch shorts a resistor to establish a higher current through the fuse that will cause the fuse to open.

14. The control circuit of claim 13 wherein an increase in resistance of the sensor will yield a voltage potential from the voltage divider circuit that switches on the second switch when the sensor detects a predetermined flammable vapor concentration that is about 50 percent of the lower flammability level.

15. The control circuit of claim 14 wherein the power source comprises at least one battery.

16. The control circuit of claim 15 further comprising a means for shutting down the appliance burner circuit when the battery voltage level is below a predetermined value.

17. A control circuit in connection with a thermocouple voltage source that powers a solenoid in a gas valve circuit of an appliance, for shutting off the flow of gas to discontinue operation of the appliance burner, the control circuit comprising:

a power source for powering the control circuit, a first switch that is connected in series with the gas valve solenoid of the appliance in a manner such that the thermocouple current to the gas valve solenoid is interrupted when the first switch opens to cause the flow of gas to the burner to be shut off;

a first sensor capable of detecting the presence of a predetermined level of flammable vapors, the first sensor responsively increasing in resistance as the concentration of flammable vapors increases;

a second sensor capable of detecting the presence of a second vapor, where the second sensor responsively decreases in resistance as the concentration of second vapor increases;

a fuse that normally conducts current from the power source to the first switch to maintain a conductive state of the first switch for supplying thermocouple current to the gas valve solenoid;

a second switch, which in response to the first and second sensors detection of the presence of a predetermined level of a first or second vapor concentration, switches a current through the fuse which opens the fuse and interrupts the current for maintaining the first switch in a conductive state, such that the first switch interrupts the thermocouple voltage applied to the gas valve solenoid to shut off the gas to the burner; and a voltage divider circuit incorporating the first sensor and the second sensor, so that the detection of a predetermined level of flammable vapors by the first sensor or the detection of a predetermined level of a second vapor by the second sensor yields a voltage potential between the first sensor and the second sensor that activates the second switch device for switching a current from the power source through the fuse that will open the fuse to interrupt current to the first switching means to cause the flow of gas to the burner to be shut-off.

18. The control circuit of claim 17 wherein the first sensor's resistance increases as the concentration of flammable vapor increases.

19. The control circuit of claim 18 wherein the voltage potential of the voltage divider circuit switches the single second switch on when the first sensor detects a predetermined flammable vapor concentration of about 50 percent of the lower flammability level.

20. The control circuit of claim 19 wherein the second sensor is capable of detecting carbon monoxide gas, and the second sensor's resistance decreases as the concentration of carbon monoxide gas increases such that the voltage potential of the voltage divider circuit switches the single second switch on when the second sensor detects a predetermined carbon monoxide gas concentration.

21. The control circuit of claim 20 wherein the power source comprises at least one battery.

22. The control circuit of claim 21 further comprising a means for shutting down the appliance burner circuit when the battery voltage level is below a predetermined value.

* * * * *